US006886505B2

(12) United States Patent
Laufenberg et al.

(10) Patent No.: US 6,886,505 B2
(45) Date of Patent: May 3, 2005

(54) CYLINDER BLOCK AND DIE-CASTING METHOD FOR PRODUCING SAME

(75) Inventors: Dietmar Ulrich Laufenberg, Windeck (DE); Gerd Anton Schwertfirm, Lohmar (DE); Hans Walter Metz, Pulheim (DE)

(73) Assignee: Ford Global Technologies, LLC, Dearborn, MI (US)

( * ) Notice: Subject to any disclaimer, the term of this patent is extended or adjusted under 35 U.S.C. 154(b) by 64 days.

(21) Appl. No.: 10/248,796

(22) Filed: Feb. 19, 2003

(65) Prior Publication Data

US 2003/0172884 A1 Sep. 18, 2003

(51) Int. Cl.[7] ..... F02F 1/10
(52) U.S. Cl. ..... 123/41.74; 123/41.81
(58) Field of Search ..... 123/41.72, 52.1, 123/41.74, 41.81; 29/888.01

(56) References Cited

U.S. PATENT DOCUMENTS

| | | | | | |
|---|---|---|---|---|---|
| 563,140 | A | * | 6/1896 | Davis | 123/41.77 |
| 923,491 | A | * | 6/1909 | Coffee | 123/41.78 |
| 2,405,847 | A | * | 8/1946 | Pullin | 123/41.81 |
| 4,394,850 | A | * | 7/1983 | Hayashi | 123/41.74 |
| 4,686,943 | A | * | 8/1987 | Anno et al. | 123/41.74 |
| 4,712,517 | A | * | 12/1987 | Anno et al. | 123/41.74 |
| 5,121,786 | A | | 6/1992 | Kawase et al. | |
| 6,129,057 | A | | 10/2000 | Langer | |

FOREIGN PATENT DOCUMENTS

| | | | |
|---|---|---|---|
| DE | 373 532 | | 4/1923 |
| DE | 736 743 | | 3/1943 |
| DE | 28 36 810 | | 3/1980 |
| EP | 1 167 735 | A2 | 1/2002 |
| GB | 2065765 | * | 7/1981 |
| JP | 61 116053 | | 6/1986 |

* cited by examiner

*Primary Examiner*—Henry C. Yuen
*Assistant Examiner*—Katrina Harris
(74) *Attorney, Agent, or Firm*—Raymond L. Coppiellie

(57) ABSTRACT

The invention relates to a cylinder block of the closed-deck type, which can be produced by die-casting. The cylinder block includes a water jacket surrounding the cylinders adapted to be open to the side. The lateral opening can be closed by a cover, which is additionally shaped on its inside in such a way as to promote flow distribution or heat dissipation.

15 Claims, 1 Drawing Sheet

CYLINDER BLOCK AND DIE-CASTING METHOD FOR PRODUCING SAME

BACKGROUND OF INVENTION

The invention relates to a cylinder block of the closed-deck type containing a cast cylinder-block core with at least one cylinder and a water jacket. The invention furthermore relates to a method for producing a closed-deck type cylinder block.

DE28 36 810 A1 discloses a cylinder block of the "closed-deck" type produced by die-casting a light alloy. The water jacket of the cylinder block disclosed therein, however, is open toward the crankcase at the bottom. The cylinder block has a number of cylinders to accommodate the pistons of an internal combustion engine, the cylinders being surrounded by a water jacket for the purpose of cooling. Closed-deck type cylinder blocks are characterized by a water jacket that is substantially closed at the top portion of the cylinder block, with the exception of any relatively small passages that may be present.

In contrast, open-deck type cylinder blocks are characterized by water jackets that extend as far as, and open toward, the top of the cylinder block. In the final engine assembly, the water jackets are covered by the subsequently fitted cylinder head. The water jackets of open-deck type cylinder blocks have to be sealed during the cylinder head assembly. This sealing process is generally very fault-prone and involved. Moreover, from a structural point-of-view, cylinder blocks of the open-deck type are less sturdy and rigid.

Die-casting is a desirable process for manufacturing cylinder blocks. However, since the production of a cylinder block of the closed-deck type by die-casting entails major problems, this method has hitherto been used almost exclusively to produce cylinder blocks of the open-deck type. Thus, there exists a need for a closed-deck type cylinder block capable of being produced by die-casting.

SUMMARY OF INVENTION

The present invention provides a practical way of producing a cylinder block of the closed-deck type by die-casting.

The closed-deck cylinder block according to the invention includes a cast cylinder-block core with at least one cylinder and a water jacket. The cylinder block is characterized by a cylinder-block core that does not surround the water jacket on the outer side facing away from the cylinder. The water jacket is otherwise closed toward the top and bottom of the cylinder block.

According to one embodiment, a closed-deck type cylinder block is provided which includes a cast cylinder-block core with at least one cylinder and a water jacket, wherein the cylinder-block core does not surround the water jacket on an outer side facing away from the cylinder. The cylinder-block core is produced by die-casting. Further, the cylinder-block core can include ribs for reinforcing or cooling on the outer side facing away from the cylinder. A cover can also be provided enclosing the water jacket on the outer side facing away from the cylinder. Further, the water jacket can extend only over the upper 20% to 50% of the height of the cylinder.

In the present cylinder block, the water jacket is thus not open upward (open-deck) or downward at its narrow side but is substantially completely open toward the outside, i.e., laterally. This makes it possible to produce the cylinder-block core by a die-casting method, thereby allowing economical mass production of the cylinder block. At the same time, the cylinder block has the advantages of the closed-deck type, i.e. simpler and better sealing of the cylinders by the cylinder head and a resultingly more rigid cylinder block.

In another advantageous configuration of the invention, the side facing away from the cylinder, i.e. the side contacting the water jacket, is configured in such a way that improved cooling can be accomplished, such as, for example, by cooling ribs. The side facing away from the cylinder can additionally or alternatively be configured to include reinforcing ribs to reduce cylinder deformations due to the combustion pressure and/or due to bolt forces.

In one embodiment, the cylinder block includes a cover which is connected to the cylinder-block core and which closes the water jacket on the side facing away from the cylinder. This cover is thus used to close the water-jacket side that was left open in the die-casting process for production reasons. Since the side concerned is subjected neither to extreme pressure nor to extreme temperature loads, the cover does not have to meet exceptionally demanding requirements. However, it is advantageous if the cover comprises of a material which, while being very sturdy, has good heat-conduction properties.

According to a another embodiment of the invention, the cover can be shaped or profiled in such a way in the direction of the water jacket, that the flow or heat distribution in the water jacket is optimized. Because a relatively large lateral wall surface of the water jacket is formed by the separate cover, the surface can be given an optimum shape without being subject to the manufacturing limitations of a casting production method.

According to another embodiment, the water jacket of the cylinder block extends approximately over the upper 20 to 50% of the height of the cylinder. It is in this area that most of the heat of combustion arises. This embodiment is advantageous in that it provides efficient cooling in the region of greatest thermal load.

According to a further embodiment of the cylinder block, the cylinder-block core also integrally comprises a crankcase which surrounds the crankshaft.

The cylinder-block core can furthermore comprise a light-weight metal, such as aluminum.

The present invention furthermore provides a method for the production of a closed-deck cylinder block wherein the cylinder-block core is produced by a die-casting method. The laterally open water jacket is furthermore formed by corresponding projections in the die-casting die or is machined out of the casting obtained on completion of the die-casting process. One advantage of the present production method is the use of a die-casting process, which allows economical mass production.

According to one embodiment of the method, a lateral cover of the water jacket is connected to the cylinder-block core. This connection can be accomplished by bolting. Because the water jacket is closed by its own cover on its open side, rather than being closed by the cylinder head, as with open-deck forms, the corresponding boundary surfaces can be configured in an optimum manner with respect to the less demanding requirements of a water-jacket seal.

Other advantages and features of the invention will also become apparent upon reading the following detailed description and appended claims, and upon reference to the accompanying drawings.

BRIEF DESCRIPTION OF DRAWINGS

For a more complete understanding of this invention, reference should now be made to the embodiment illustrated in greater detail in the accompanying drawings and described below by way of examples of the invention.

In the drawings.

DETAILED DESCRIPTION

Figure 1:
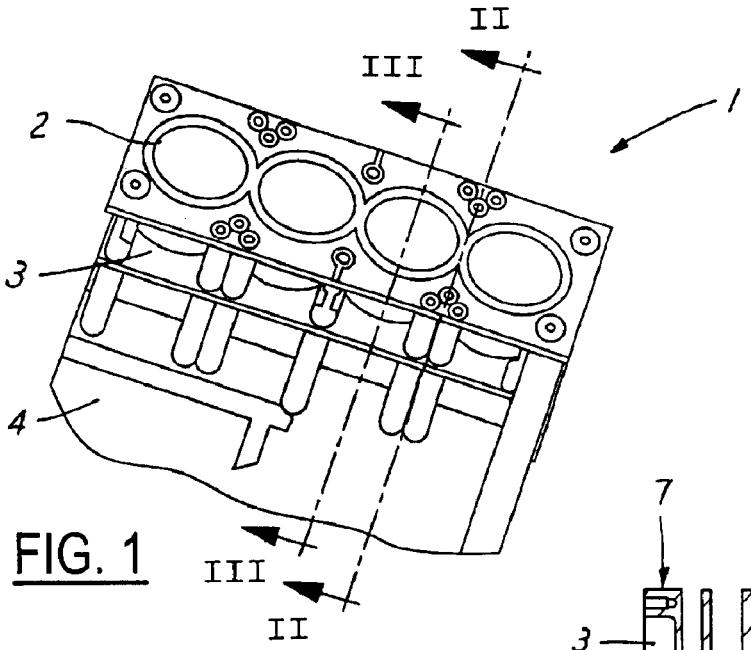
FIG. 1 shows a perspective view of a cylinder-block core and a cylinder block according to one embodiment the invention.

The following example is provided with reference to an in-line four-cylinder engine. This embodiment is exemplary only and is not meant to be limiting. Indeed, the present invention can be implemented in cylinder blocks for in-line, opposed, or offset engine configurations with one to sixteen cylinders, for example.

The figures show a one-piece cylinder-block core 1 of a four-cylinder in-line engine. The cylinder-block core 1 has four cylinders 2 in contact with one another (sometimes referred to as "siamese" cylinders), to the bottom end of which a crankcase 4 is fitted. The cylinders on the inside will eventually house the piston assembly. Adjacent cylinders may share a common cylindrical wall portion as shown. A water jacket 3 is formed as a cavity on the outward-facing side walls of the cylinders 2. The upper side 7 of the cavity is closed. The cylinder-block core 1 is of the closed-deck type, which has advantages in terms of sturdiness and reliability for sealing by the cylinder head (not shown).

Figure 2:
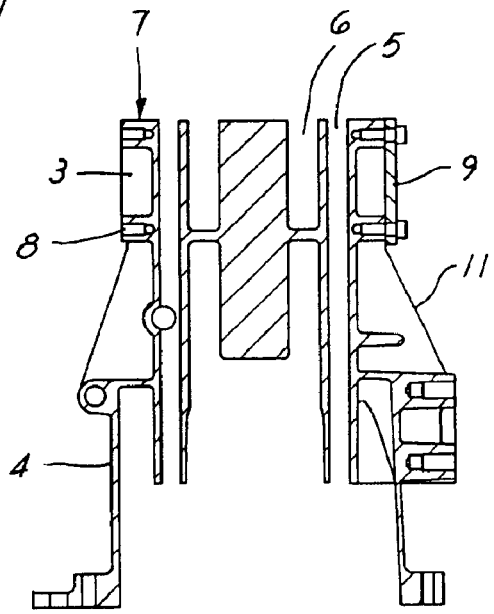
FIG. 2 shows a cross-sectional view along the line II—II in FIG. 1.
Figure 3:
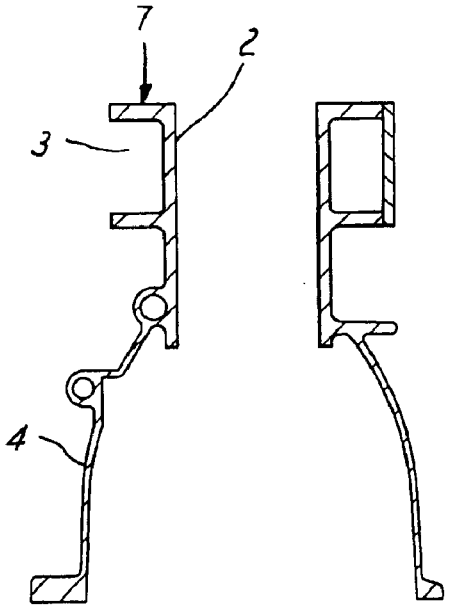
FIG. 3 shows a cross-sectional view along the line III—III in FIG. 1.

According to the examples shown in FIGS. 1 through 3, the water jacket 3 is open towards the cylinder-block core 1. This makes it possible to produce the cylinder-block core 1 by die-casting and, at the same time, to achieve the closed-deck form. The cavities of the water jacket 3 can be formed by corresponding projections in the die-casting die. Alternatively, the water jacket cavities can be milled into the cylinder-block core from the side after the die-casting has been produced.

Drilled holes 8 with an internal thread are furthermore provided in the sides of the cylinder-block core, allowing respective covers 9 (only one of which is shown in FIGS. 2 and 3) made of sheet metal or some other suitable material to be bolted onto the water jackets. This cover 9 is preferably shaped and designed in such a way on its inside that it optimizes the flow of water and heat distribution. The sectional view in FIG. 2 furthermore shows the water-jacket chambers 6 situated between two cylinders 2 and the bolt holes 5 for the cylinder head, which extend parallel to the cylinders 2.

The cylinder-block core 1 can be made of a lightweight metal such as aluminum. In the example shown, the water jacket 3 extends over approximately the upper 20% to 50% of the height of the respective cylinder 2. The water jacket 3 could, of course, extend over a greater region of the outside cylinder surface. The side of the casting facing away from the respective cylinder 2 can further include one or more ribs 11. The ribs 11 can act as cooling ribs and/or reinforcing ribs. The ribs 11 can also contact the water jacket 3.

While the invention has been described in connection with one or more embodiments, it should be understood that the invention is not limited to those embodiments. Thus, the invention covers all alternatives, modifications, and equivalents as may be included in the spirit and scope of the appended claims.

What is claimed is:

1. A cylinder block of the closed-deck type containing a cast cylinder-block core with at least two cylinders and a water jacket, wherein adjacent cylinders share a common cylindrical wall portion, and wherein the cylinder-block core does not surround the water jacket on an outer side facing away from the cylinder, and wherein the water jacket extends along only an upper 20% to 50% of the height of the cylinder.

2. The cylinder block as claimed in claim 1 wherein the cylinder-block core is produced by die-casting.

3. The cylinder block as claimed in claim 1 wherein the cylinder-block core comprises at least one rib on the outer side facing away from the cylinder.

4. The cylinder block as claimed in claim 3 comprising a cover connected to the cylinder-block core and enclosing the water jacket on the outer side facing away from the cylinder.

5. The cylinder block as claimed in claim 1 comprising a cover connected to the cylinder-block core and enclosing the water jacket on the outer side facing away from the cylinder.

6. The cylinder block as claimed in claim 1 wherein the cylinder-block core comprises a crankcase.

7. The cylinder block as claimed in claim 1 comprising 2 to 16 cylinders.

8. A cylinder block of the closed-deck type containing a cast cylinder-block core with at least two cylinders and a water jacket, wherein adjacent cylinders share a common cylindrical wall portion, and wherein the cylinder-block core does not surround the water jacket on an outer side facing away from the cylinder, and wherein the cylinder-block core is made of aluminum.

9. A method of producing a closed-deck type cylinder block having at least two cylinders wherein adjacent cylinders share a common cylindrical wall portion, the method comprising the steps of die-casting a cylinder-block core and a water jacket wherein the cylinder-block core does not surround the water jacket on an outer side facing away from the cylinder, and forming the water jacket by machining a cavity into a lateral portion of the outer side facing away from the cylinder.

10. The method of claim 9 comprising connecting a cover to sealingly engage the water jacket.

11. The method of claim 9 comprising forming, during die-casting, at least one rib on the outer side facing away from the cylinder.

12. A method of producing a closed-deck type cylinder block having at least two cylinders wherein adjacent cylinders share a common cylindrical wall portion, the method comprising the steps of die-casting a cylinder-block core and a water jacket wherein the cylinder-block core does not surround the water jacket on an outer side facing away from the cylinder, and wherein the water jacket extends along only an upper 20% to 50% of the height of the cylinder.

13. A closed-deck type cylinder block comprising:

a die-cast cylinder-block core having at least two cylinders with adjacent cylinders sharing a common cylindrical wall portion;

a lateral water jacket formed on an outer side of the cylinder-block core facing away from the cylinder such that the cylinder-block core does not enclose the water jacket on the outer side; and a cover connected to the cylinder-block core enclosing the water jacket on the outer side facing away from the cylinder, wherein the water jacket extends along only an upper 20% to 50% of the height of the cylinder.

14. The cylinder block as claimed in claim 13 wherein the outer side includes at least one rib.

15. The cylinder block as claimed in claim 13 wherein the cylinder-block core comprises a crankcase.

* * * * *